US008814547B2

(12) United States Patent
Walgren et al.

(10) Patent No.: US 8,814,547 B2
(45) **Date of Patent: *Aug. 26, 2014**

(54) SEAL RETAINING SLEEVE FOR GEAR PUMP

(75) Inventors: Timothy P. Walgren, Byron, IL (US); Satish Shantilal Shah, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 748 days.

This patent is subject to a terminal disclaimer.

(21) Appl. No.: 13/035,031

(22) Filed: Feb. 25, 2011

(65) Prior Publication Data

US 2012/0219445 A1 Aug. 30, 2012

(51) Int. Cl.
*F04C 2/08* (2006.01)
*F04C 18/08* (2006.01)
*F16C 3/00* (2006.01)

(52) U.S. Cl.
USPC ..... 418/206.6; 418/205; 464/182

(58) Field of Classification Search
USPC ..... 418/83, 91, 94, 205, 206.8, 206.6; 464/182
See application file for complete search history.

(56) References Cited

U.S. PATENT DOCUMENTS

| | | | | |
|---|---|---|---|---|
| 1,902,346 | A | 3/1933 | Vogt | |
| 2,301,496 | A | 11/1942 | Aldrich | |
| 2,884,268 | A * | 4/1959 | Amirault et al. | 277/362 |
| 3,018,641 | A | 1/1962 | Carpigiani | |
| 3,045,778 | A | 7/1962 | Mosbacher | |
| 3,126,834 | A * | 3/1964 | Bursak | 418/206.5 |
| 3,182,596 | A | 5/1965 | Prijatel | |
| 3,435,773 | A | 4/1969 | Gustafsson | |
| 3,824,041 | A | 7/1974 | Rystrom | |
| 3,833,317 | A | 9/1974 | Rumsey | |
| 4,097,206 | A | 6/1978 | Schonherr | |
| 4,290,739 | A | 9/1981 | Korse | |
| 4,631,009 | A | 12/1986 | Cygnor et al. | |
| 5,004,407 | A | 4/1991 | Hutchison | |
| 5,071,328 | A | 12/1991 | Schlictig | |
| 5,586,875 | A | 12/1996 | Ondrejko et al. | |
| 6,135,741 | A | 10/2000 | Oehman, Jr. | |
| 6,138,646 | A | 10/2000 | Hansen et al. | |
| 6,223,775 | B1 | 5/2001 | Hansen et al. | |
| 6,241,498 | B1 | 6/2001 | Hansen et al. | |

(Continued)

FOREIGN PATENT DOCUMENTS

| | | | |
|---|---|---|---|
| CN | 2179920 | Y | 10/1994 |
| CN | 101725325 | A | 6/2010 |

(Continued)

OTHER PUBLICATIONS

Chinese Search Report for CN Application No. 201210043355.X mailed May 30, 2014.

*Primary Examiner* — Mary A Davis
(74) *Attorney, Agent, or Firm* — Carlson, Gaskey & Olds, P.C.

(57) ABSTRACT

A shaft assembly includes a shaft with a first radial shoulder and a second radial shoulder along a shaft axis. A seal retaining sleeve is defined around the shaft axis to position a shaft seal. A retainer plate at least partially between the first radial shoulder and the second radial shoulder is adjacent to the seal retaining sleeve to position and provide access to the seal retaining sleeve and shaft seal.

23 Claims, 13 Drawing Sheets

(56) References Cited

U.S. PATENT DOCUMENTS

| | | | | |
|---|---|---|---|---|
| 6,321,527 | B1 | 11/2001 | Dyer et al. | |
| 6,601,854 | B2 * | 8/2003 | Auber | 277/377 |
| 6,705,847 | B1 | 3/2004 | Sagawe et al. | |
| 7,094,042 | B1 | 8/2006 | Borgetti et al. | |
| 7,878,781 | B2 | 2/2011 | Elder | |
| 2002/0061256 | A1 | 5/2002 | Hansen et al. | |
| 2006/0024188 | A1 | 2/2006 | Muscarella et al. | |
| 2007/0034265 | A1 * | 2/2007 | Mohr et al. | 137/580 |
| 2007/0178003 | A1 | 8/2007 | Zhu et al. | |
| 2009/0148333 | A1 | 6/2009 | Elder | |
| 2009/0159370 | A1 * | 6/2009 | Maners et al. | 184/6.12 |
| 2012/0219446 | A1 * | 8/2012 | Walgren et al. | 418/205 |

FOREIGN PATENT DOCUMENTS

| | | |
|---|---|---|
| GB | 1037797 | 8/1966 |
| JP | 2000087872 A | 3/2000 |
| JP | 2006063889 A | 3/2006 |

* cited by examiner

SEAL RETAINING SLEEVE FOR GEAR PUMP

BACKGROUND

The present disclosure relates to a pump, and more particularly to a fuel gear pump for gas turbine engines.

Fuel gear pumps are commonly used to provide fuel flow and pressure for gas turbine engines and other systems on aircrafts. The gear pump must perform over a wide system operating range and provide critical flows and pressures for various functions. Typically, these pumps receive rotational power from an accessory gearbox through a drive shaft.

In a fuel gear pump, a shaft seal is frequently used to seal internal fuel from entry into a shaft cavity. Typically, the shaft seal performance, most notably leakage, may be monitored throughout operation, where too much leakage may cause detrimental effects. In addition, the shaft seal may need to be periodically removed, examined, possibly repaired or replaced, then re-installed. Dependant on the arrangement of the unit, the shaft seal may be difficult to access, which is usually the case in a dual gear stage pump.

SUMMARY

A shaft assembly according to an exemplary aspect of the present disclosure includes a shaft with a first radial shoulder and a second radial shoulder along a shaft axis. A seal retaining sleeve is defined around the shaft axis and a retainer plate at least partially between the first radial shoulder and the second radial shoulder is adjacent to the seal retaining sleeve.

A gear pump according to an exemplary aspect of the present disclosure includes an input shaft which at least partially extends from a housing along an input shaft axis, the input shaft defines a first radial shoulder and a second radial shoulder. A seal retaining sleeve is located within a bore in the housing. A retainer plate is mounted to the housing at least partially between the first radial shoulder and the second radial shoulder to restrain an axial position of the input shaft, and the retainer plate is adjacent to the seal retaining sleeve.

A method of installing a shaft assembly within a housing according to an exemplary aspect of the present disclosure includes positioning a shaft seal within a bore in the housing, a seal retaining sleeve within the bore in the housing, and a shaft at least partially within the bore through the seal retaining sleeve and the shaft seal along a shaft axis. Attaching a retainer plate to the housing, the retainer plate is located at least partially between a first radial shoulder and a second radial shoulder to restrain an axial position of the shaft, and the retainer plate is adjacent to the seal retaining sleeve.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
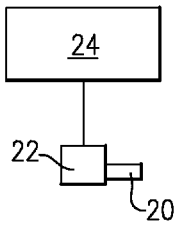
FIG. 1 is a block diagram of a gear pump driven by an accessory gearbox to communicate a fluid such as fuel to a gas turbine.

FIG. 1 schematically illustrates a gear pump 20 driven by an accessory gearbox 22 to communicate a fluid such as fuel to a gas turbine 24. It should be appreciated that the present application is not limited to use in conjunction with a specific system. Thus, although the present application is, for convenience of explanation, depicted and described as being implemented in an aircraft fuel pump, it should be appreciated that it can be implemented in numerous other systems. In addition, although a dual stage gear pump is disclosed, other machines with a shaft will also benefit herefrom.

Figure 2:
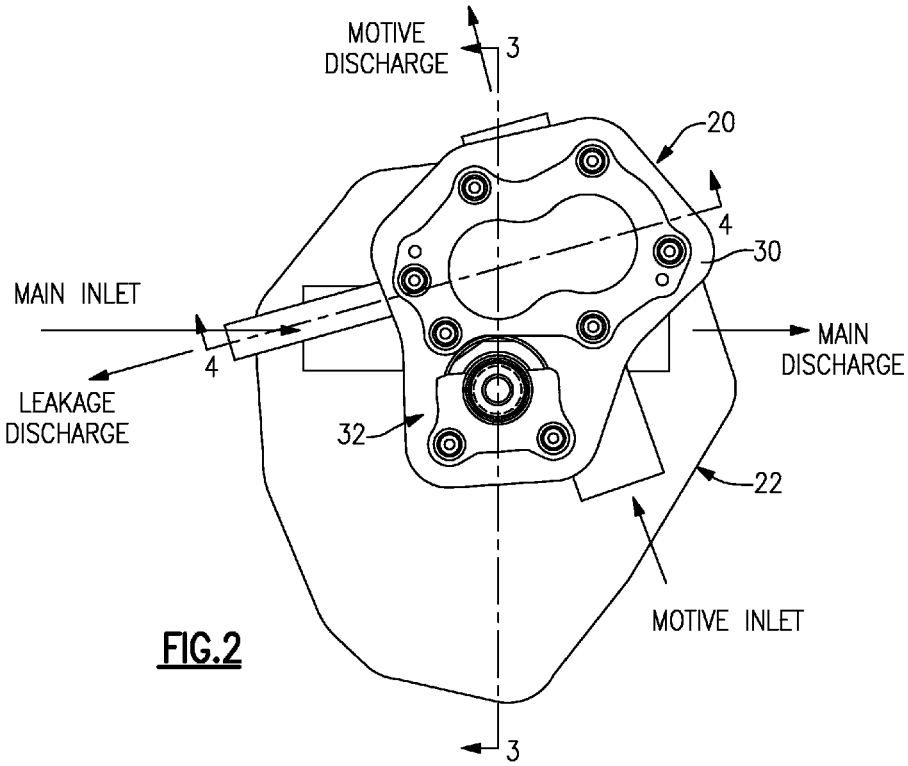
FIG. 2 is an end view of a gear pump.
Figure 3:
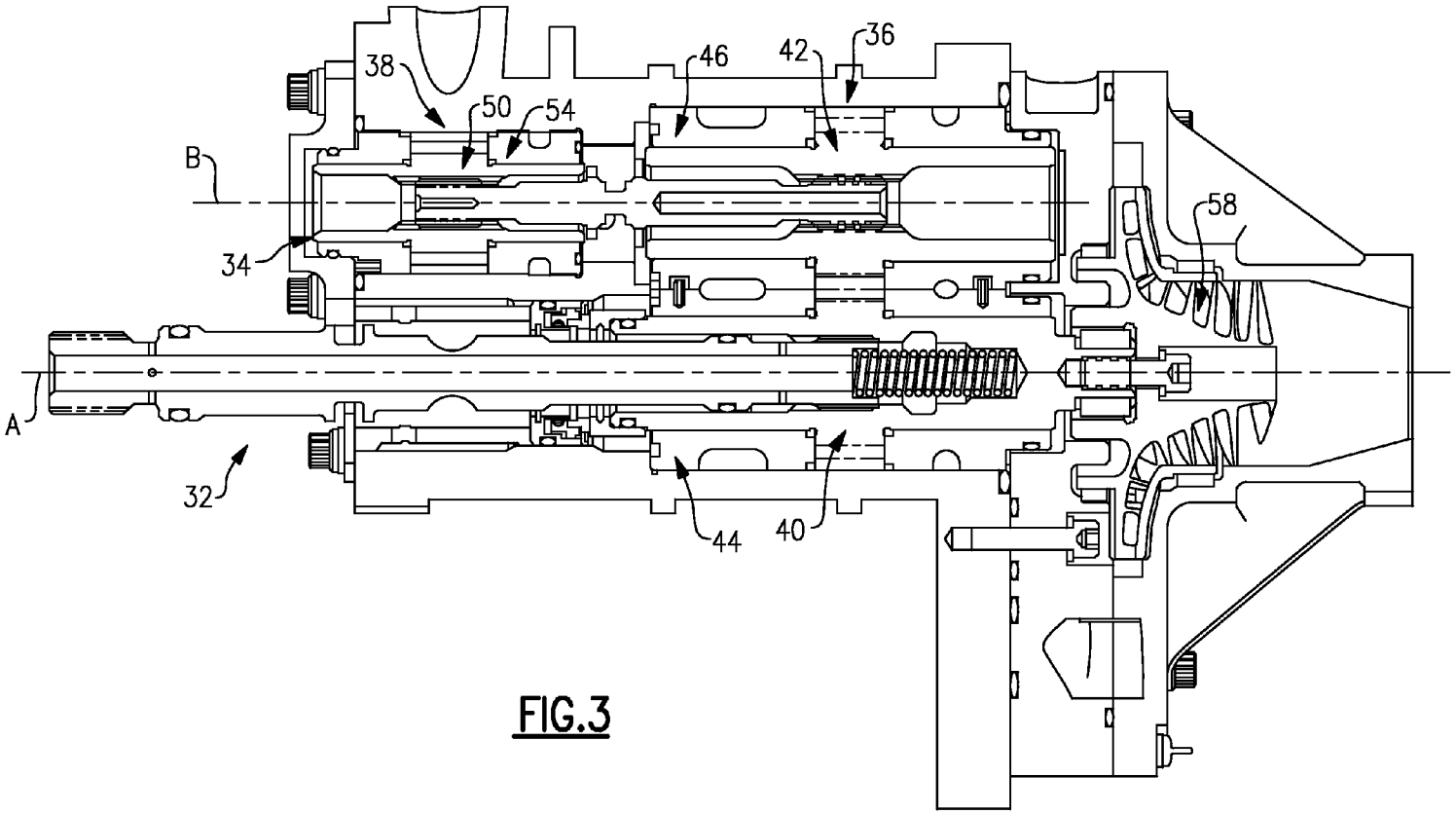
FIG. 3 is a sectional view of the gear pump taken along line 3-3 in FIG. 2.
Figure 4:
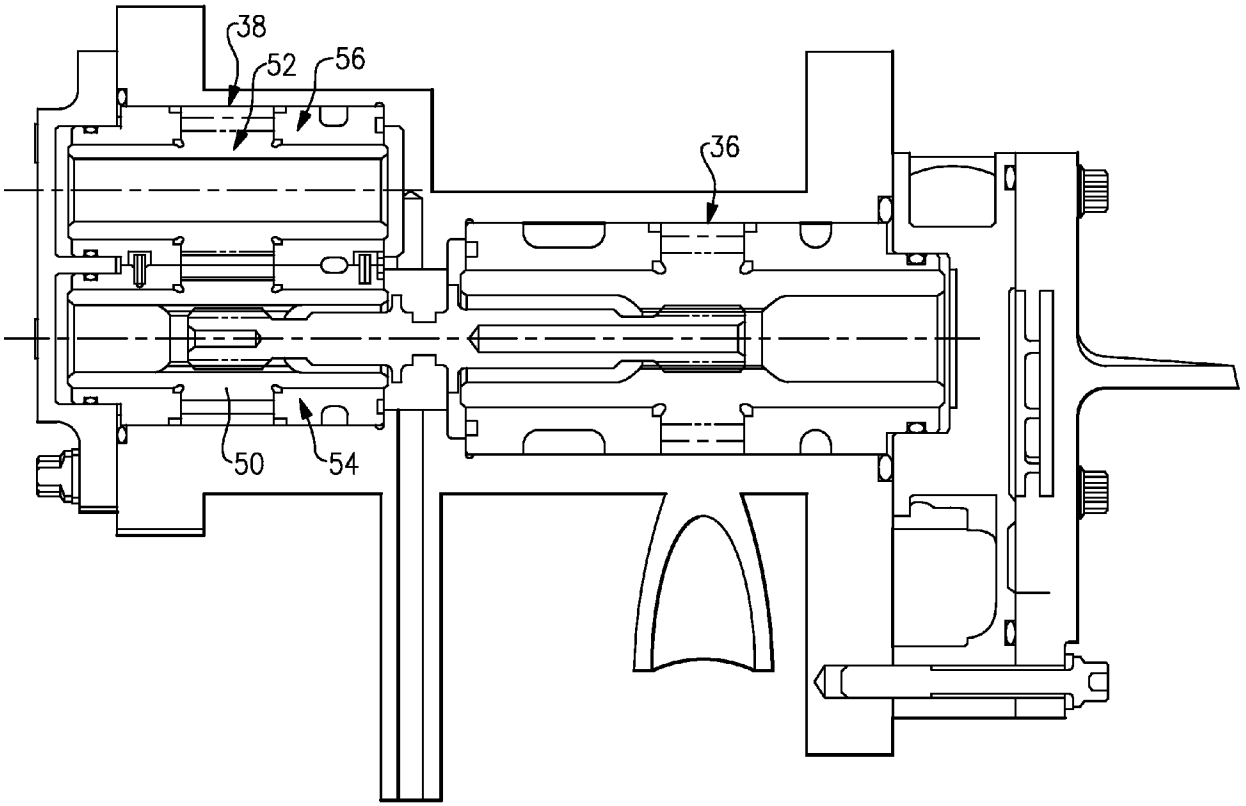
FIG. 4 is a sectional view of the gear pump taken along line 4-4 in FIG. 2.

With reference to FIG. 2, the gear pump 20 generally includes a housing 30 that includes an input shaft assembly 32 and a coupling shaft assembly 34 to power a main stage 36 and a motive stage 38 (FIGS. 3 and 4). Rotational power is transferred from the gas turbine 24 to the accessory gearbox 22 then to the gear pump 20 through the input shaft assembly 32. In the disclosed, non-limiting embodiment, the input shaft assembly 32 interfaces with the accessory gearbox 22 and receives a lubricant therefrom while the coupling shaft assembly 34 is lubricated with fuel.

With reference to FIG. 3, the input shaft assembly 32 is defined along an input axis A and the coupling shaft assembly 34 is defined along a coupling axis B parallel to the input axis A. The main stage 36 generally includes a main drive gear 40, a main driven gear 42, a main drive bearing 44 and a main driven bearing 46. The motive stage 38 generally includes a motive drive gear 50, a motive driven gear 52, a motive drive bearing 54 and a motive driven bearing 56 (FIG. 4).

Figure 5:
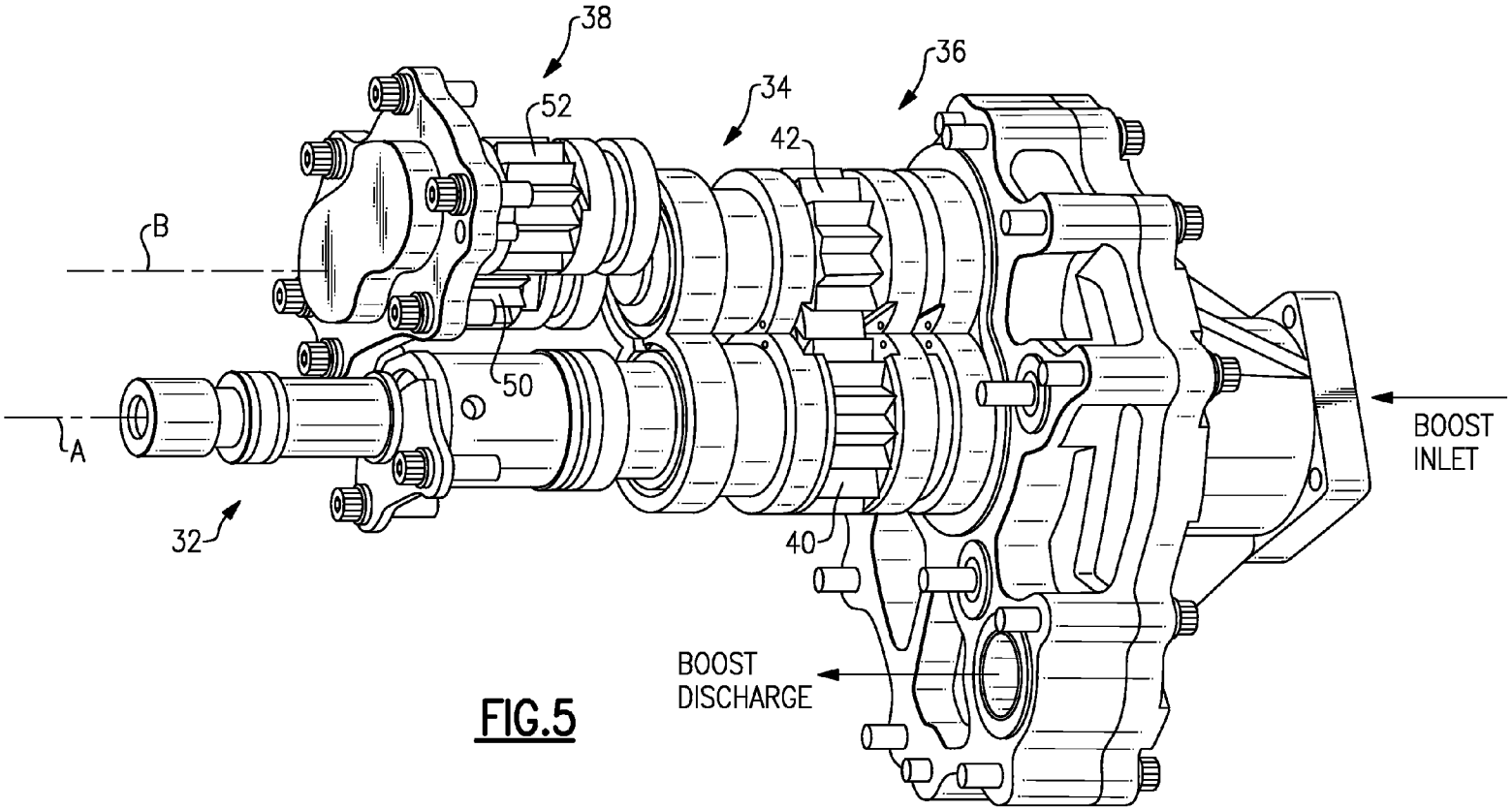
FIG. 5 is a perspective view of the gear pump with the housing removed.
Figure 6:
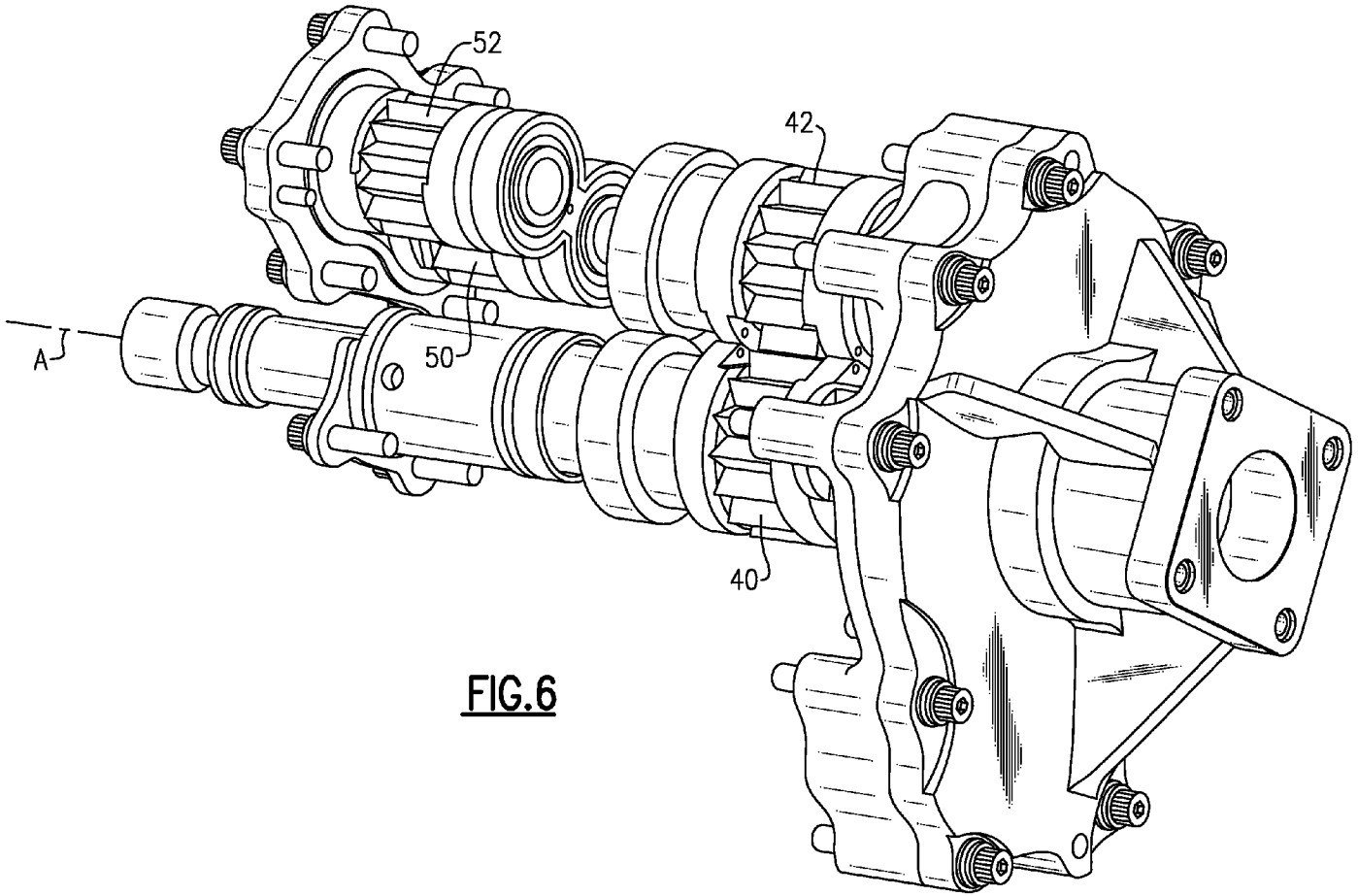
FIG. 6 is another perspective view of the gear pump with the housing removed.
Figure 7:
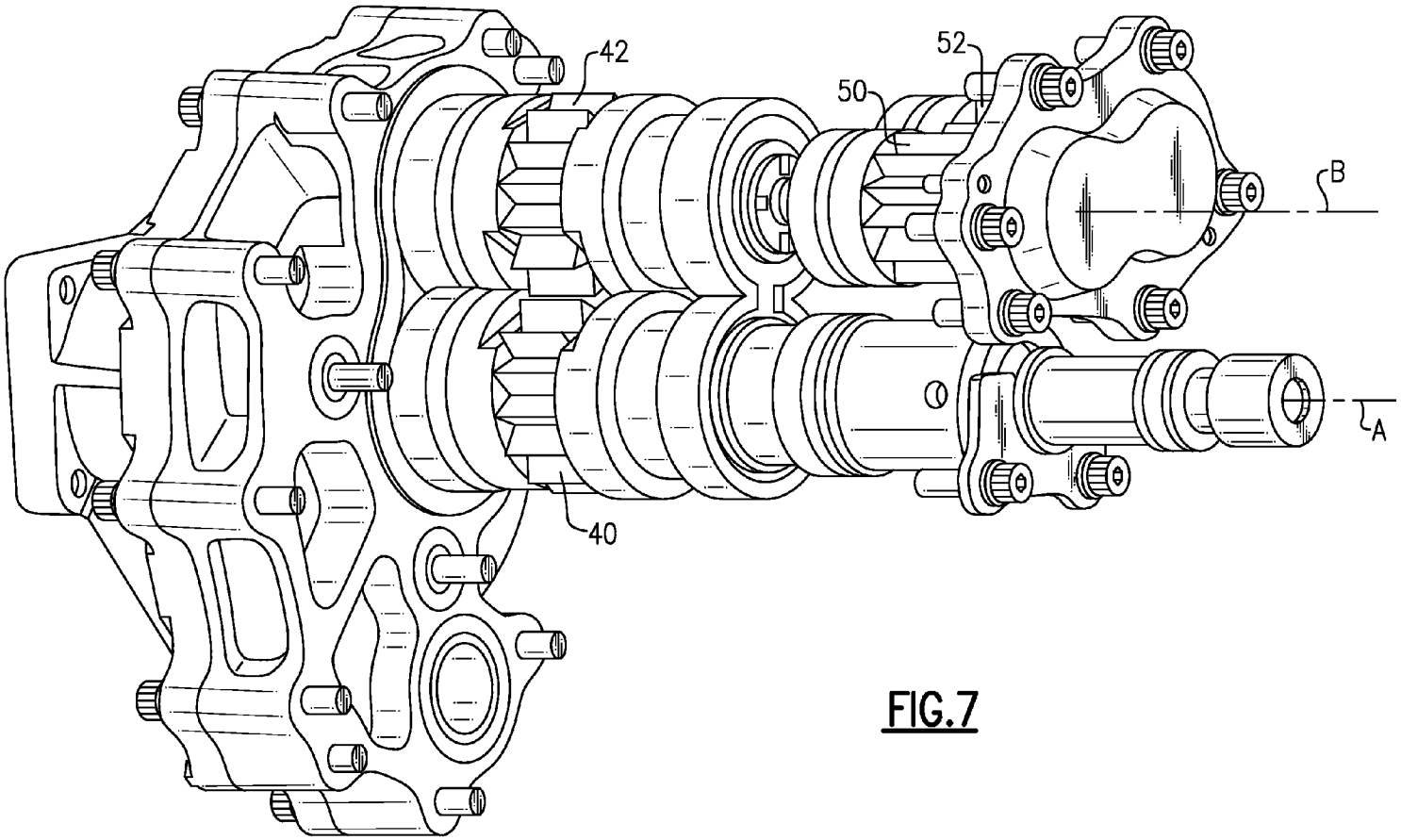
FIG. 7 is another perspective view of the gear pump with the housing removed.

The main drive gear 40 is in meshed engagement with the main driven gear 42 and the motive drive gear 50 is in meshed engagement with the motive driven gear 52 (FIGS. 5-7). The input shaft assembly 32 drives the coupling shaft assembly 34 through the main stage 36 to drive the motive stage 38. A boost stage 58 is also driven by the input shaft assembly 32 to define a centrifugal pump with an impeller and integrated inducer.

Figure 8:
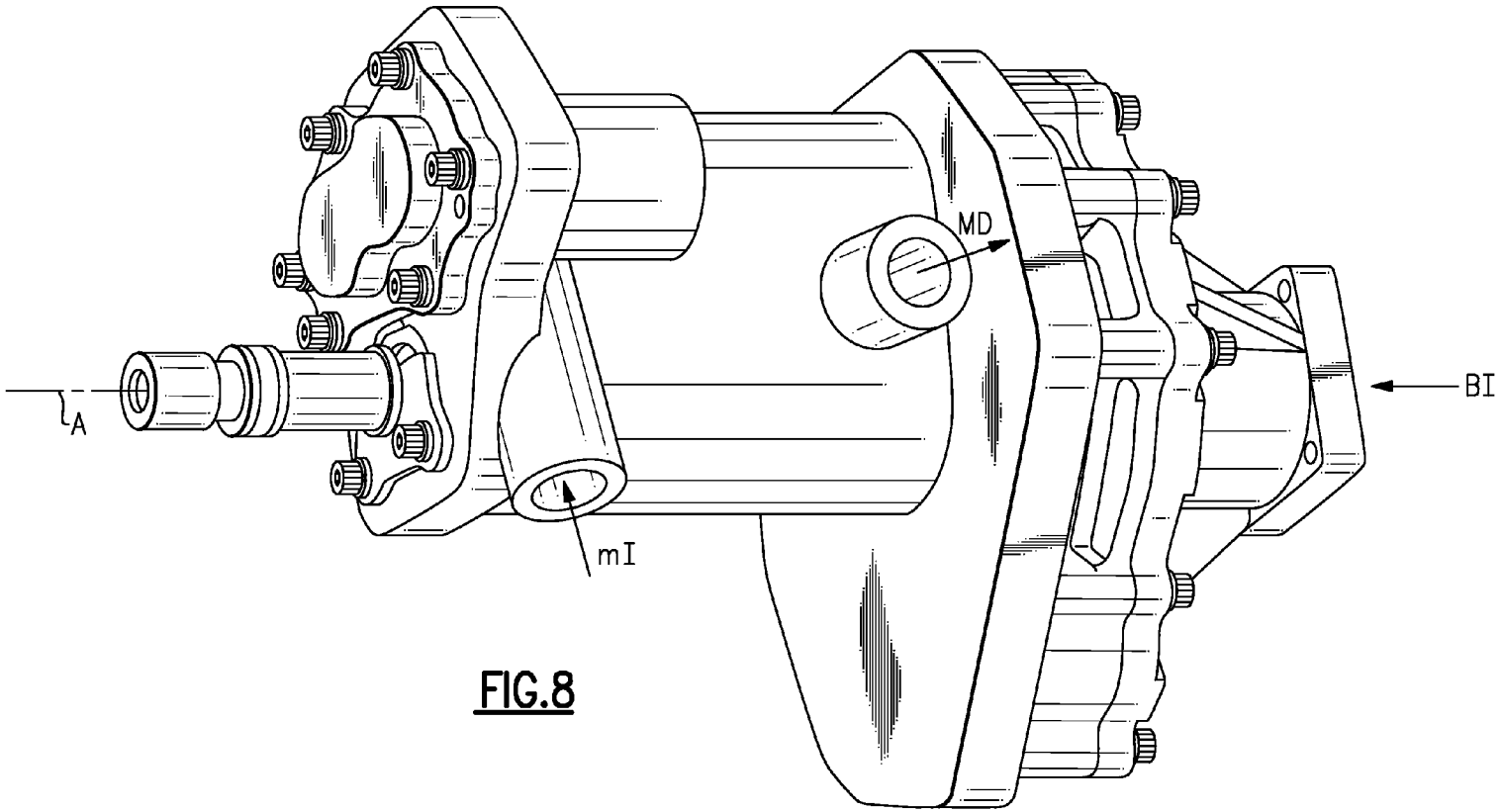
FIG. 8 is a perspective view of the gear pump from the same perspective as in FIG. 5.
Figure 9:
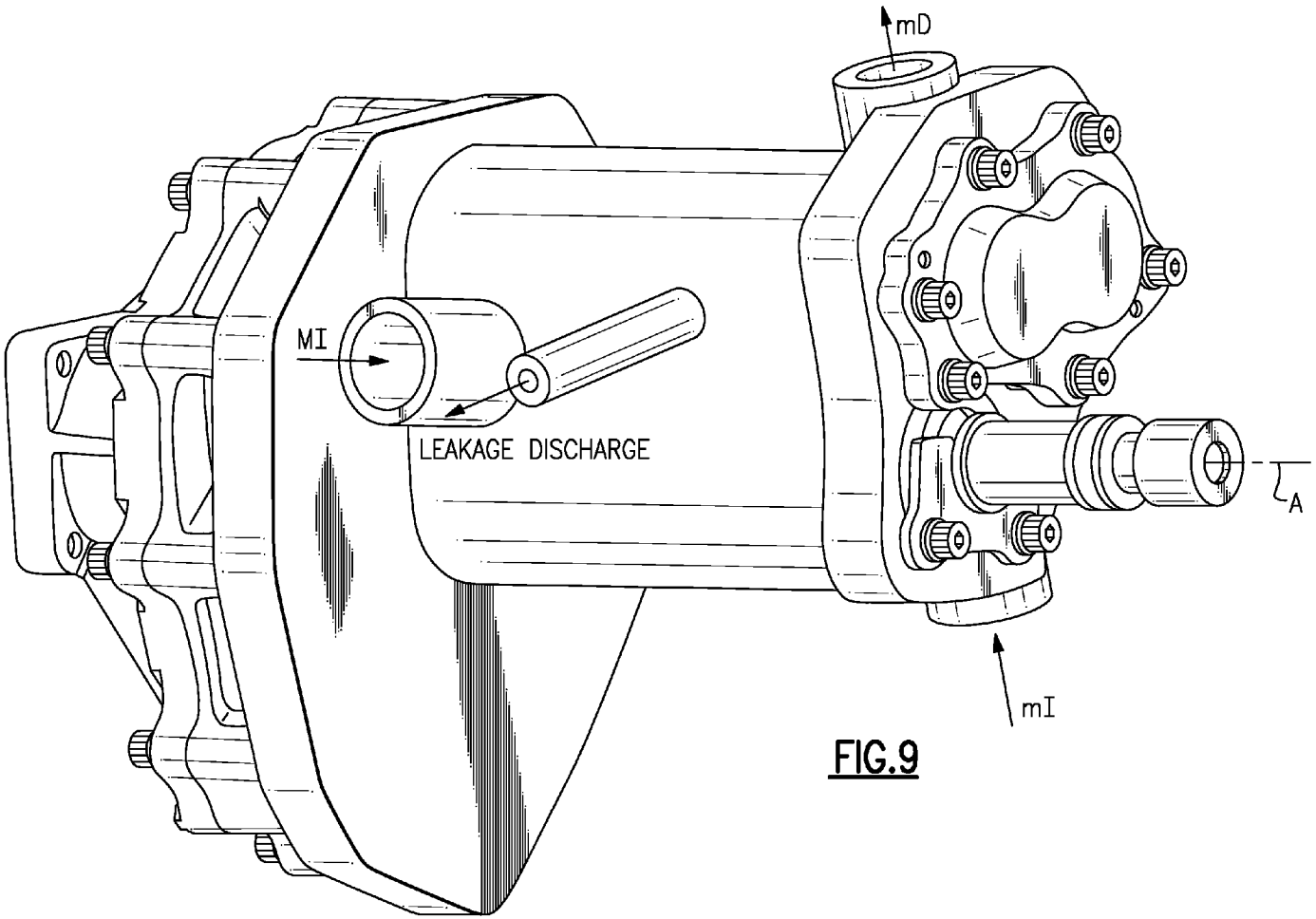
FIG. 9 is a perspective view of the gear pump from the same perspective as in FIG. 7.
Figures 10, 12:
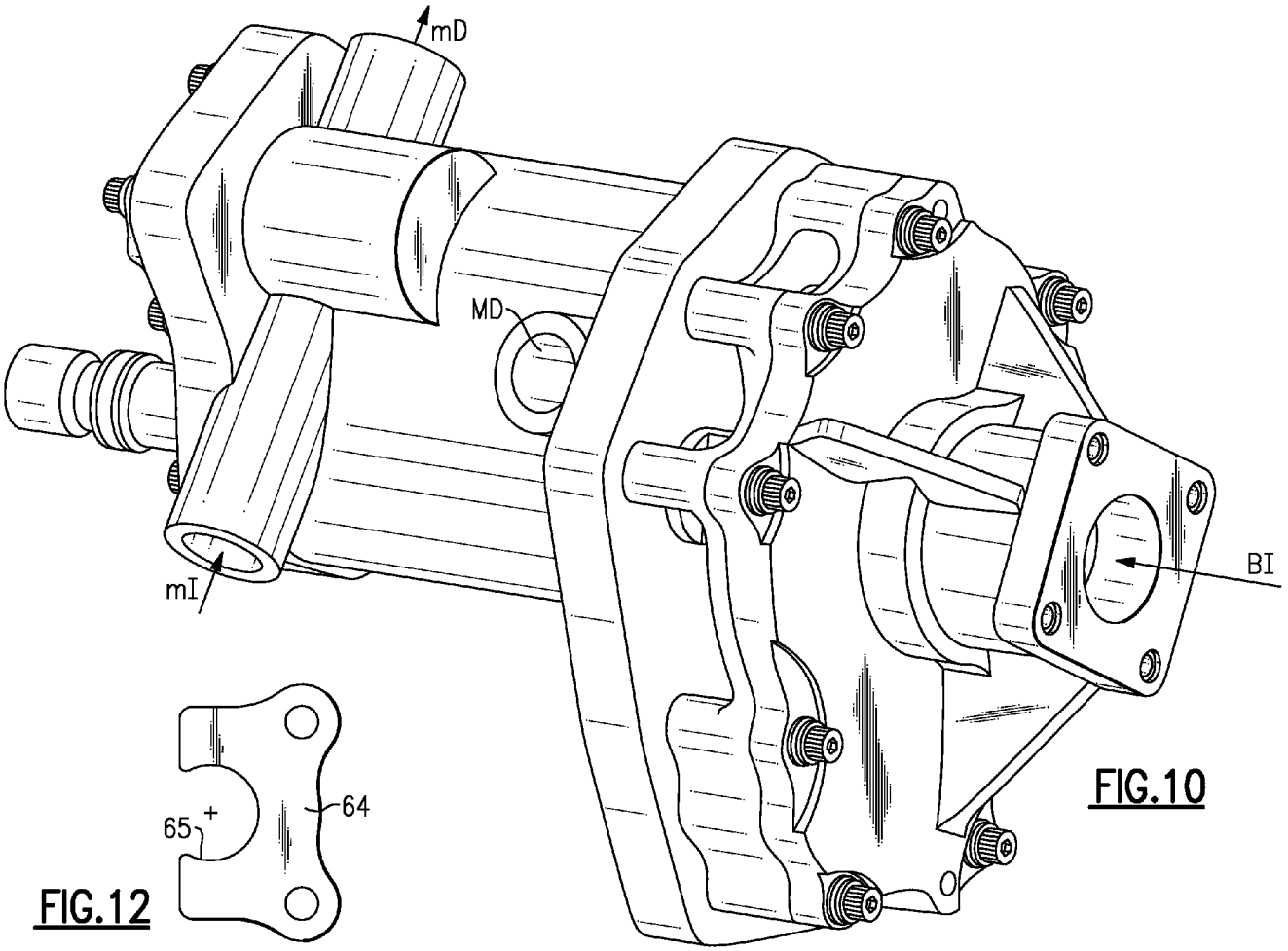
FIG. 10 is a perspective view of the gear pump from the same perspective as in FIG. 6.
FIG. 12 is an end view of a retainer plate of the input shaft assembly.

The stages 36, 38, 58 work mostly independently. Each stage 36, 38, 58 includes a separate inlet and discharge (FIGS. 8-10). As the meshed gears 40, 42 and 50, 52 rotate, respective volumes of fluid are communicated from the main stage inlet MI to the main stage discharge MD and from a motive stage inlet ml to a motive stage discharge mD such that the main stage 36 communicates a main fuel flow while the motive stage 38 supplies a motive fuel flow. The main stage inlet MI and main stage discharge MD as well as the motive stage inlet ml and motive stage discharge mD are respectively directed along generally linear paths through the respective gear stage 36, 38.

In the disclosed non-limiting embodiment, an aircraft fuel system provides flow and pressure to the boost stage inlet BI. A portion of the boost stage discharge is routed internally to the motive stage inlet ml. The remainder of the boost stage discharge is discharged from the gear pump 20 to the aircraft fuel system, then returns to the main stage inlet MI. The motive stage discharge mD is communicated to the aircraft fuel system. The main stage discharge MD is also communicated to the aircraft fuel system to provide at least two main functions: actuation and engine burn flow. There may be alternative or additional relatively minor flow directions and functions, but detailed description thereof need not be further disclosed herein.

Figure 11:
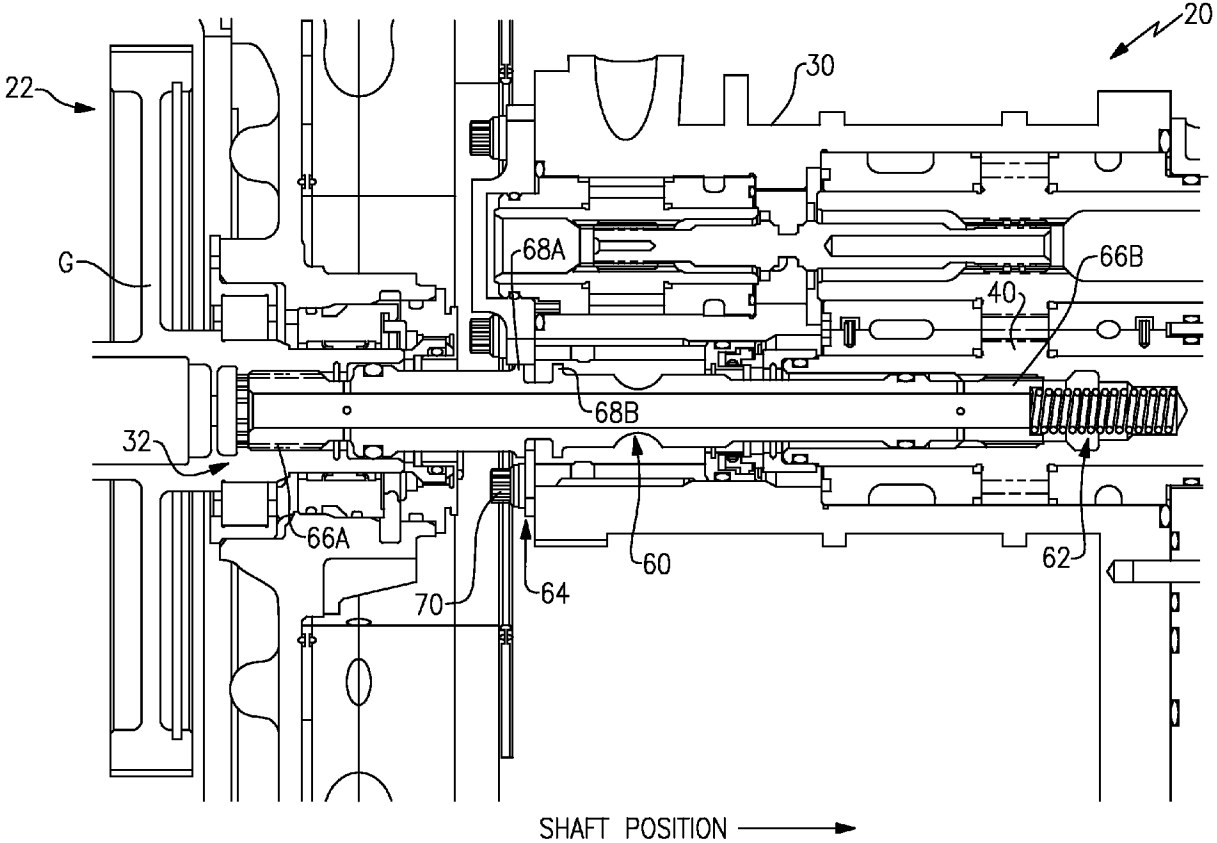
FIG. 11 is an expanded sectional view of an input shaft assembly of the gear pump.

With reference to FIG. 11, the input shaft assembly 32 includes an input shaft 60, a spring 62 and a retainer plate 64. The input shaft 60 is a hollow shaft with splined end sections 66A, 66B and radial shoulders 68A, 68B therebetween. The splined end section 66A plugs into a gear G of the accessory gearbox 22. The splined end section 66B interfaces with the main drive gear 40.

The radial shoulders 68A, 68B are generally aligned with the housing 30 to receive the retainer plate 64 therebetween. The retainer plate 64 is attached to the housing 30 through fasteners 70 such as bolts (also illustrated in FIG. 2) to position an interrupted opening 65 between the radial shoulders 68A, 68B. The interrupted opening 65 in one disclosed non-limiting embodiment is an arcuate surface with an interruption less than 180 degrees (FIG. 12). The axial position of the input shaft 60 is thereby axially constrained by the interaction of the radial shoulders 68A, 68B and to the retainer plate 64.

Figure 13:
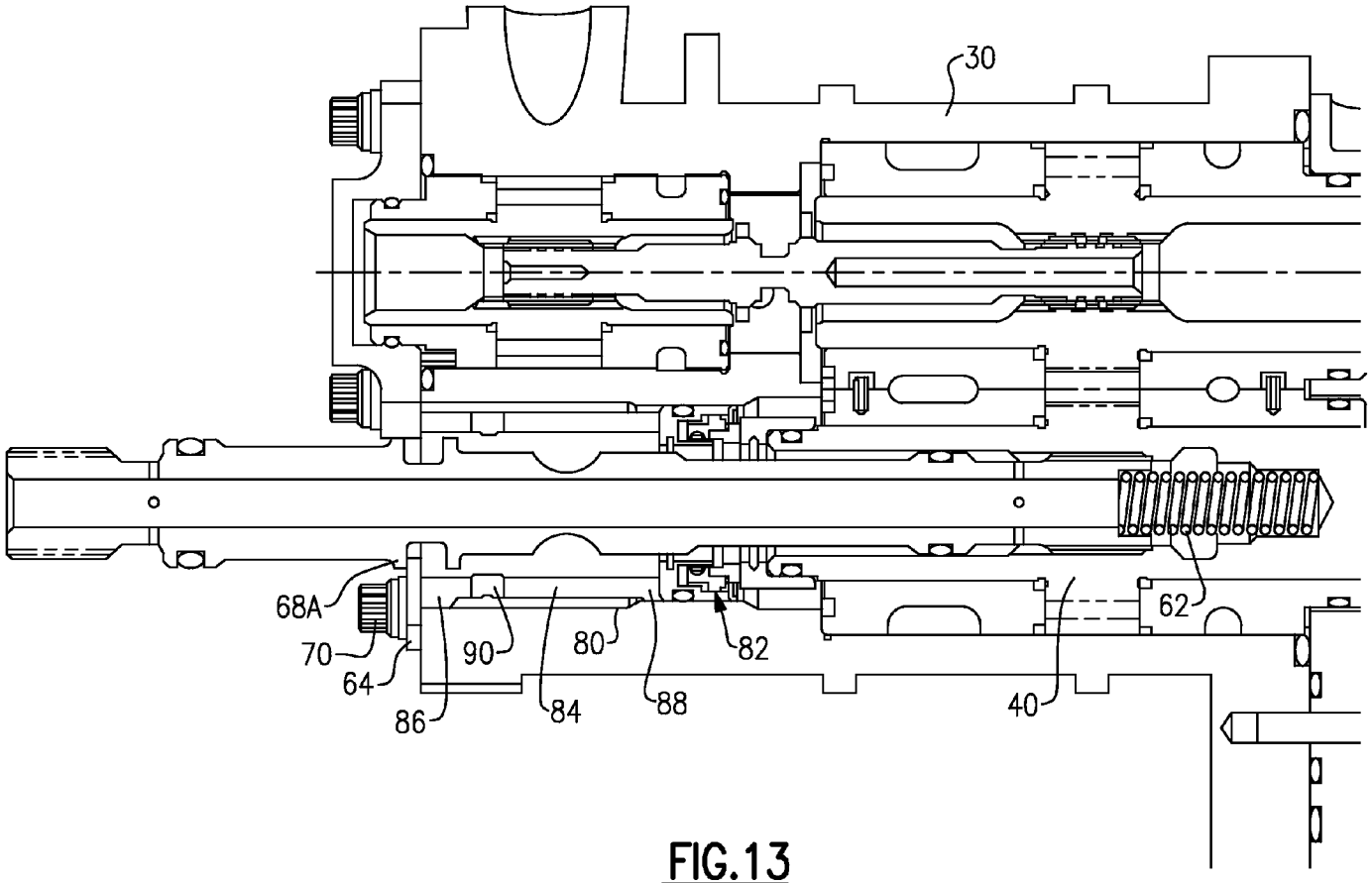
FIG. 13 is an expanded sectional view of an input shaft assembly of the gear pump while being installed into an accessory gearbox.

With reference to FIG. 13, the spring 62 biases the input shaft assembly 32 to position the input shaft assembly 32 during gear pump operation. That is, the spring 62 allows the input shaft assembly 32 to move in the housing 30 in response to impact loads, until the input shaft assembly 32 bottoms out on the retainer plate 64, but during operation, the spring 62 positions the input shaft assembly 32 such that the radial shoulders 68A, 68B are spaced from the retainer plate 64. This assures there are no rotational to stationary part contact during operation.

Figure 14:
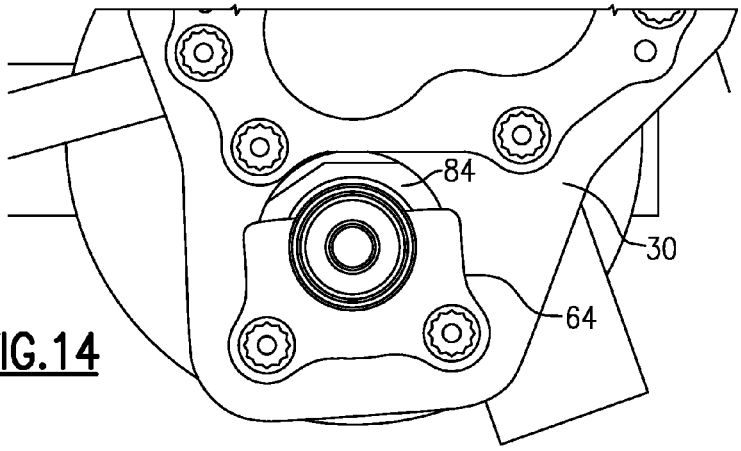
FIG. 14 is an end view of the input shaft assembly of the gear pump.

The input shaft assembly 32 rotationally mounts the input shaft 60 within a shaft bore 80 which contains a shaft seal 82 such as that manufactured by Qualiseal Technology of Illinois USA and a seal retaining sleeve 84. The shaft seal 82 is located within the shaft bore 80 then the seal retaining sleeve 84 is located within the shaft bore 80 to position the shaft seal 82 between the seal retaining sleeve 84 and the main drive gear 40. The retainer plate 64, through removable attachment to the housing 30 through the fasteners 70, retains the seal retaining sleeve 84 and thereby the position of the shaft seal 82 (FIG. 14).

The shaft seal 82 seals fuel from the main stage 36 and the motive stage 38 into the shaft bore 80 then potentially into the accessory gearbox 22. Performance of the shaft seal 82, most notably leakage, may be monitored throughout operation, where too much leakage may cause detrimental effects. The shaft seal 82 may periodically require maintenance or replacement. Removal of the shaft seal 82 is facilitated by removal of the retainer plate 64 and the seal retaining sleeve 84 as compared to conventional systems which locate the shaft seal deep within the housing. That is, unlike many conventional designs, the gear pump 20 does not have to be mostly or completely disassembled in order to access and remove the shaft seal 82.

Figure 15:
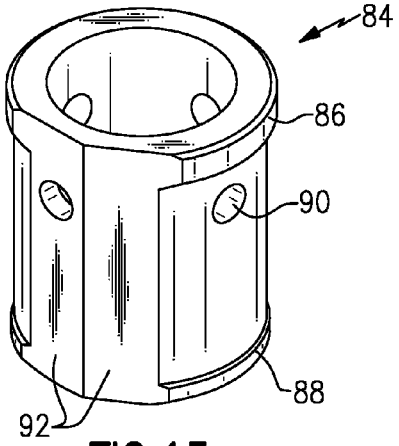
FIG. 15 is a perspective isometric view of the seal retaining sleeve.

The seal retaining sleeve 84 includes radial end flanges 86, 88 which may be of different diameters (FIG. 15). The different diameters facilitate the assembly-proof location of the seal retaining sleeve 84 into the shaft bore 80 which reduces in diameter toward the shaft seal 82. The reduced diameter shaft bore 80 over the axial length thereof further facilitates and eases location of the shaft seal 82 through the shaft bore 80.

Figure 16:
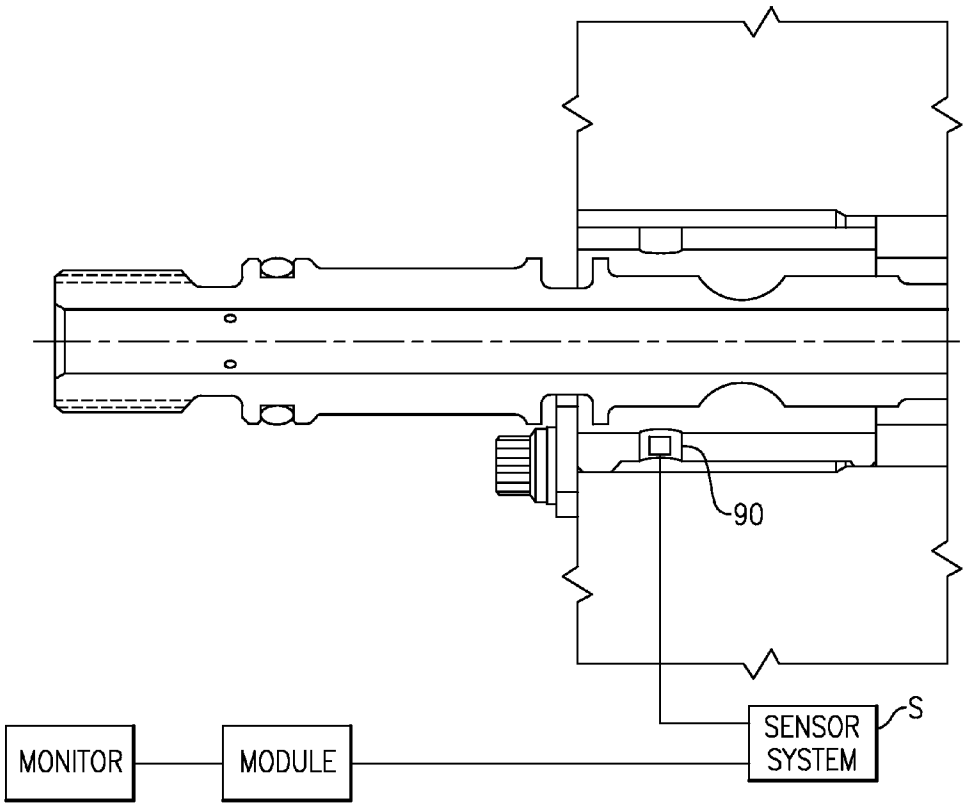
FIG. 16 is an expanded sectional view of the seal retaining sleeve with a sensor system integrated therewith.

The seal retaining sleeve 84 includes apertures 90 which facilitate removal through receipt of a tool (not shown) which engages the apertures 90. The apertures 90 may further permit receipt of a sensor system S (illustrated schematically; FIG. 16) or other monitor which, for example only, senses and tracks the position of the seal retaining sleeve 84 relative the shaft bore 80 which monitors wear of the shaft seal 82. Alternatively, or additionally, the sensor system S may be utilized to detect any fuel leakage past the shaft seal 82 and into the seal retaining sleeve 84 and the shaft bore 80. It should be understood by those skilled in the art with the benefit of this disclosure that these functions may be enacted in either dedicated hardware circuitry or programmed software routines capable of execution in a microprocessor based electronics control embodiment. In one non-limiting embodiment, the module may be a portion of a flight control computer, a portion of a central vehicle control, an interactive vehicle dynamics module, a stand-alone line replaceable unit or other system.

The seal retaining sleeve 84 may alternatively or additionally include anti-rotation features 92 such as flats (illustrated; FIG. 15), grooves, keys, or other features to further rotationally assembly-proof and align the seal retaining sleeve 84 for specific leakage, performance and assembly monitoring.

Figure 17:
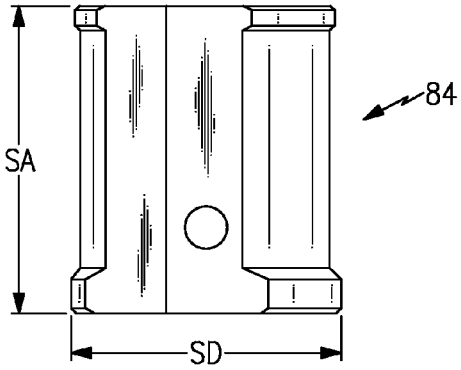
FIG. 17 is a side view of one dimensional embodiment of a seal retaining sleeve.

With reference to FIG. 17, the seal retaining sleeve 84 defines an overall axial length SA along the axis of rotation A and an outer diameter dimension SD of the radial end flange 86. It should be understood that the radial end flange 86 in the disclosed non-limiting embodiment defines the maximum outer diameter dimension to closely fit into the shaft bore 80 opposite the shaft seal 82, however, other maximum outer diameter surfaces may alternatively or additionally be utilized herewith.

The axial dimension SA in one disclosed non-limiting dimensional embodiment is 1.600-2.000 inches (40.6-50.8 mm) with a nominal dimension of 1.800 inches (45.7 mm). The maximum outer diameter dimension SD in this disclosed non-limiting dimensional embodiment is 1.368-1.768 inches (34.7-44.9 mm) with a nominal maximum outer diameter dimension of 1.568 inches (39.8 mm). In this disclosed non-limiting dimensional embodiment, a ratio of SD/SA is defined between 0.68-1.11.

Figure 18:
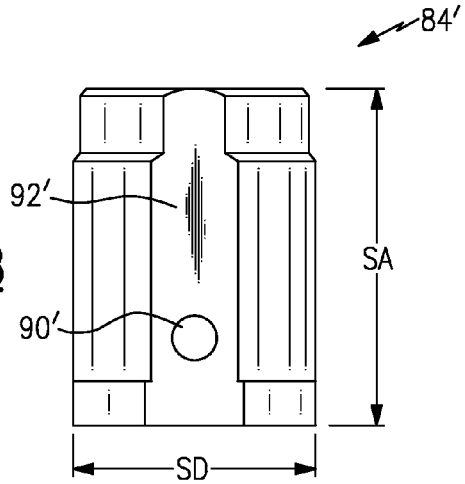
FIG. 18 is a side view of another dimensional embodiment of a seal retaining sleeve.

With reference to FIG. 18, another non-limiting embodiment of the seal retaining sleeve 84' defines an overall axial length SA along the axis of rotation A and an outer diameter dimension SD of the radial end flange 86'.

The axial dimension SA in another disclosed non-limiting dimensional embodiment is 1.695-2.095 inches (43.1-53.2 mm) with a nominal dimension of 1.895 inches (48.1 mm). The maximum outer diameter dimension SD in this disclosed non-limiting dimensional embodiment is 1.174-1.574 inches (29.8-40.0 mm) with a nominal maximum outer diameter dimension of 1.374 inches (34.9 mm). In this disclosed non-limiting dimensional embodiment, a ratio of SD/SA is defined between 0.69-0.93. The disclosed ratios permit the seal retaining sleeve 84 to closely fit into the shaft bore 80 and properly locate the shaft seal 82 as retained by the retainer plate 64.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A shaft assembly comprising:

a shaft with a first radial shoulder and a second radial shoulder along a shaft axis;

a seal retaining sleeve defined around said shaft axis; and a retainer plate at least partially between said first radial shoulder and said second radial shoulder, the first radial shoulder and the second radial shoulder capturing the retainer plate therebetween such that an axial position of the shaft is restrained, said retainer plate adjacent to said seal retaining sleeve.

2. The shaft assembly as recited in claim 1, wherein said seal retaining sleeve defines an inner diameter greater than an outer diameter of said first radial shoulder and said second radial shoulder.

3. The shaft assembly as recited in claim 1, wherein said first radial shoulder and said second radial shoulder are both located between a first splined end section and a second splined end section.

4. The shaft assembly as recited in claim 1, wherein said retainer plate is mountable to a gear pump housing.

5. The shaft assembly as recited in claim 1, wherein said seal retaining sleeve includes radial end flanges of different diameters.

6. The shaft assembly as recited in claim 1, further comprising a shaft seal through which said shaft is mounted, said seal retaining sleeve abuts said shaft seal.

7. The shaft assembly as recited in claim 1, wherein an overall axial length of said seal retaining sleeve defines an axial distance SA and a maximum outer diameter dimension SD, a ratio of SD/SA defined between 0.68 -1.11.

8. The shaft assembly as recited in claim 7, wherein said maximum outer diameter dimension SD is defined at a radial end flange.

9. The shaft assembly as recited in claim 1, wherein said first radial shoulder comprises a first surface and said second radial shoulder comprises a second surface, said first surface facing said second surface.

10. The shaft assembly as recited in claim 1, wherein said retainer plate abuts said first radial shoulder establishing an end point of a range of axial movement of said shaft, and said retainer plate abuts said second radial shoulder establishing an opposite end point of said range of axial movement of said shaft.

11. The shaft assembly as recited in claim 1, wherein said seal retaining sleeve has a flat portion, groove, or key such that rotation of said seal retaining sleeve is restrained.

12. A gear pump comprising:

a gear pump housing;

an input shaft which at least partially extends from said gear pump housing along an input shaft axis, said input shaft defines a first radial shoulder and a second shoulder;

a seal retaining sleeve within a bore in said gear pump housing, said seal retaining sleeve defined around said shaft axis; and a retainer plate mounted to said gear pump housing, said retainer plate at least partially between said first radial shoulder and said second radial shoulder to restrain an axial position of said input shaft, said retainer plate adjacent to said seal retaining sleeve.

13. The gear pump as recited in claim 12, wherein said first radial shoulder and said second radial shoulder are both located between a first splined end section and a second splined end section.

14. The gear pump as recited in claim 12, wherein said retainer plate defines an interrupted opening.

15. The gear pump as recited in claim 12, further comprising a shaft seal within said bore through which said shaft is mounted, said seal retaining sleeve abuts said shaft seal.

16. The gear pump as recited in claim 15, wherein said seal retaining sleeve is trapped between said shaft seal and said retainer plate.

17. The gear pump as recited in claim 12, further comprising a coupling shaft assembly mounted within said gear pump housing along a coupling shaft axis, said coupling shaft axis parallel to said input shaft axis.

18. The gear pump as recited in claim 12, wherein said retainer plate is removably mountable to said gear pump housing.

19. The gear pump as recited in claim 12, wherein an overall axial length of said retaining sleeve defines an axial distance SA and a maximum outer diameter dimension SD, a ratio of SD/SA defined between 0.68 -1.11.

20. A method of installing a shaft within a housing comprising:

positioning a shaft seal within a bore in the housing;

positioning a seal retaining sleeve within the bore in the housing;

positioning the shaft at least partially within the bore through the seal retaining sleeve and the shaft seal along a shaft axis, the shaft defines a first radial shoulder and a second radial shoulder; and attaching a retainer plate to the housing, the retainer plate at least partially between said first radial shoulder and said second radial shoulder to restrain an axial position of said input shaft, said retainer plate adjacent to said seal retaining sleeve.

21. A method as recited in claim 20, further comprising:

removably mounting the retainer plate to the housing.

22. A method as recited in claim 20, further comprising:

mounting a sensor system relative to the seal retaining sleeve and the bore.

23. A method as recited in claim 20, further comprising:

mounting a sensor system adjacent to the seal retaining sleeve, the sensor system operable to detect fuel leakage.

* * * * *

UNITED STATES PATENT AND TRADEMARK OFFICE

CERTIFICATE OF CORRECTION

PATENT NO. : 8,814,547 B2
APPLICATION NO. : 13/035031
DATED : August 26, 2014
INVENTOR(S) : Timothy P. Walgren et al.

It is certified that error appears in the above-identified patent and that said Letters Patent is hereby corrected as shown below:

IN THE CLAIMS:

In claim 12, column 6, line 5; after "second" insert --radial--

Signed and Sealed this
Third Day of February, 2015

Michelle K. Lee

Michelle K. Lee
*Deputy Director of the United States Patent and Trademark Office*